US010114305B2

(12) United States Patent
Grinwald et al.

(10) Patent No.: US 10,114,305 B2
(45) Date of Patent: Oct. 30, 2018

(54) LIQUID TONER CONTAINING A LOW SYMMETRY ELECTRICALLY CONDUCTING MATERIAL FOR PRINTING CONDUCTIVE TRACES

(71) Applicant: HP Indigo B.V., Amstelveen (NL)

(72) Inventors: Yaron Grinwald, Meitar (IL); Reut Avigdor, Modiin (IL); Gregory Katz, Holon (IL); Yana Reznick, Nes Ziona (IL); Mirit Shitrit, Yavne (IL); Adi Vinegrad, Rehovot (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/502,909

(22) PCT Filed: Sep. 26, 2014

(86) PCT No.: PCT/US2014/057640

§ 371 (c)(1),
(2) Date: Feb. 9, 2017

(87) PCT Pub. No.: WO2016/048343

PCT Pub. Date: Mar. 31, 2016

(65) Prior Publication Data

US 2017/0235245 A1 Aug. 17, 2017

(51) Int. Cl.

| | |
|---|---|
| ***G03G 9/12*** | (2006.01) |
| ***G03G 9/08*** | (2006.01) |
| ***G03G 9/125*** | (2006.01) |
| ***G03G 9/135*** | (2006.01) |
| ***G03G 9/13*** | (2006.01) |

(52) U.S. Cl.
CPC ..... *G03G 9/122* (2013.01); *G03G 9/0804* (2013.01); *G03G 9/125* (2013.01); *G03G 9/131* (2013.01); *G03G 9/135* (2013.01); *G03G 9/1355* (2013.01)

(58) Field of Classification Search
CPC .... G03G 9/122; G03G 9/0804; G03G 9/1355; G03G 9/125; G03G 9/131
See application file for complete search history.

(56) References Cited

U.S. PATENT DOCUMENTS 3,405,683 A 10/1968 Jons et al.
3,900,003 A 8/1975 Sato et al.
(Continued)

FOREIGN PATENT DOCUMENTS

JP 2006091381 4/2006
WO WO-2004067647 8/2004
(Continued)

OTHER PUBLICATIONS

Eichhorn, W. et al, "Carbon Nanotube Filled Composite Material Analysis Utilizing Nano and Conventional Testing Techniques", 2010, Society for Imaging & Tech, NiP26, 5pgs.
(Continued)

*Primary Examiner* — Thorl Chea
(74) *Attorney, Agent, or Firm* — HP Inc. Patent Department

(57) ABSTRACT

A liquid toner for printing conductive traces is provided. The liquid toner includes a carrier liquid and toner particles dispersed in the carrier liquid. The toner particles include a low symmetry electrically conducting material dispersed in a pigment.

19 Claims, 6 Drawing Sheets

(56) References Cited

U.S. PATENT DOCUMENTS

| | | | | |
|---|---|---|---|---|
| 4,073,266 | A | 2/1978 | Arneth et al. | |
| 4,342,823 | A | 8/1982 | Grant et al. | |
| 4,400,079 | A | 8/1983 | Landa | |
| 4,504,138 | A | 3/1985 | Kuehnle et al. | |
| 4,690,539 | A | 9/1987 | Radulski et al. | |
| 5,749,032 | A | 5/1998 | Landa et al. | |
| 6,156,237 | A | 12/2000 | Kubota | |
| 6,623,902 | B1 | 9/2003 | Ben-Avraham et al. | |
| 8,541,072 | B2 | 9/2013 | Foley et al. | |
| 2006/0222985 | A1 | 10/2006 | Tsubuko et al. | |
| 2010/0122642 | A1* | 5/2010 | Farrugia ..... | C09D 11/101 106/31.29 |
| 2010/0198038 | A1 | 8/2010 | Nagata et al. | |
| 2010/0247891 | A1 | 9/2010 | Chang et al. | |
| 2010/0261002 | A1 | 10/2010 | Tajima et al. | |

FOREIGN PATENT DOCUMENTS

| | | |
|---|---|---|
| WO | WO-2013178265 | 12/2013 |
| WO | WO-2013180716 | 12/2013 |
| WO | WO-2014015890 | 1/2014 |

OTHER PUBLICATIONS

International Search Report and Written Opinion for International Application No. PCT/US2014/057640 dated Jun. 26, 2015, 12 pages.

* cited by examiner

LIQUID TONER CONTAINING A LOW SYMMETRY ELECTRICALLY CONDUCTING MATERIAL FOR PRINTING CONDUCTIVE TRACES

BACKGROUND

A conductive ink is an ink that results in a printed object that conducts electricity. The transformation from liquid ink to solid printing may involve drying, curing or melting processes.

These inks may be classed as fired high solids systems or PTF (polytetrafluoroethylene) polymer thick film systems that allow circuits to be drawn or printed on a variety of substrate materials such as polyester to paper. These types of inks usually contain conductive materials such as powdered or flaked silver and carbon-like materials, although polymeric conduction is also known.

Conductive inks can be a more economical way to lay down conductive traces when compared to traditional industrial standards such as etching copper from copper plated substrates to form the same conductive traces on relevant substrates, as printing is a purely additive process producing little to no waste streams which then have to be recovered or treated.

BRIEF DESCRIPTION OF THE DRAWINGS

FIGS. 1A-1C depict percolation threshold used in creating conducting lines in a composite, illustrating a sharp change as a function of filler concentration, according to an example, wherein FIG. 1A depicts the situation below the percolation threshold, FIG. 1B depicts the situation at the percolation threshold, and FIG. 1C depicts the situation above the percolation threshold.

DETAILED DESCRIPTION

Figure 1A:
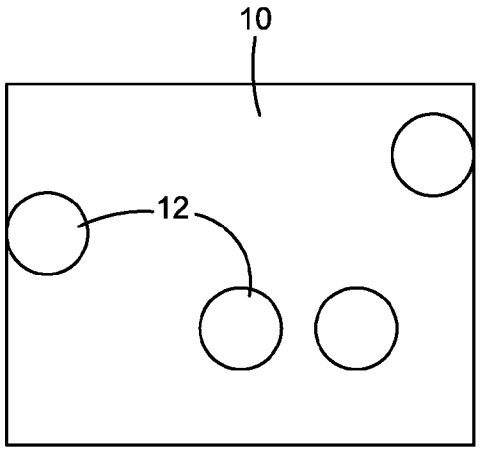

It is appreciated that, in the following description, numerous specific details are set forth to provide a thorough understanding of the examples. However, it is appreciated that the examples may be practiced without limitation to these specific details. In other instances, well-known methods and structures may not be described in detail to avoid unnecessarily obscuring the description of the examples. Also, the examples may be used in combination with each other.

While a limited number of examples have been disclosed, it should be understood that there are numerous modifications and variations therefrom. Similar or equal elements in the Figures may be indicated using the same numeral.

It is noted that, as used in this specification and the appended claims, the singular forms "a," "an," and "the" include plural referents unless the context clearly dictates otherwise.

As used herein, "liquid vehicle," "vehicle," or "liquid medium" refers to the fluid in which the electrically conducting material of the present disclosure can be dispersed to form a liquid electrophotographic ink, or toner. Such liquid vehicles and vehicle components are known in the art. Typical liquid vehicles can include but are not limited to a mixture of a variety of different agents, such as surfactants, co-solvents, buffers, biocides, sequestering agents, compatibility agents, antifoaming agents, oils, emulsifiers, viscosity modifiers, etc.

As used herein, "liquid electrophotographic ink" or "liquid toner" generally refers to an ink having a liquid vehicle, a colorant (the electrically conducting material), a charging component, and polymer(s), or resins.

As used herein, "liquid electrophotographic printing" generally refers to the process that provides a liquid electrophotographic ink, or toner, image that is electrostatically transferred from a photo imaging plate to an intermediate drum or roller, and then thermally transferred to a substrate, or to the process wherein the ink image is electrostatically transferred from the photo imaging plate directly onto a substrate. Additionally, "liquid electrophotographic printers" generally refer to those printers capable of performing electrophotographic printing, as described above. These types of printers are different than traditional electrophotographic printers that utilized essentially dry charged particles to image a media substrate.

As used herein, the term "about" is used to provide flexibility to a numerical range endpoint by providing that a given value may be "a little above" or "a little below" the endpoint. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and subrange is explicitly recited. As an illustration, a numerical range of "about 1 to about 5 weight percent (wt %)" should be interpreted to include not only the explicitly recited values of about 1 wt % to about 5 wt %, but also include individual values and sub-ranges within the indicated range. Thus, included in this numerical range are individual values such as 2, 3.5, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

The percolation threshold for carbon black has been well-studied. The symmetry of carbon black particles as used in these studies is close to spherical geometry. With spherical geometry, the percolation threshold of carbon black in an insulating media such as a resin, is at 16.7% PL (Pigment Loading) (volumetric). This means that below this PL threshold, the solid film is insulating and above it conductive.

Figure 1B:
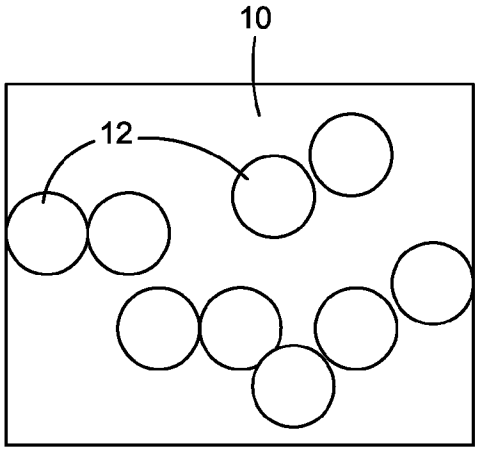
Figure 1C:
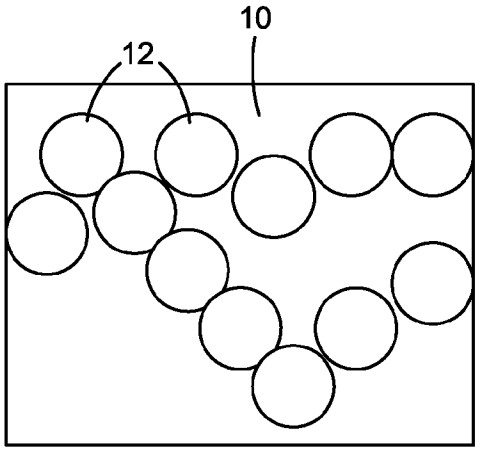

FIGS. 1A-1C illustrate this effect schematically. FIGS. 1A-1C depict carbon black particles 12 in a medium 10, such as a resin. In FIG. 1A, the carbon black particles 12 are below the percolation threshold and as such, do not form conducting lines. In FIG. 1B, the carbon black particles 12 are at the percolation threshold, and are seen to form a conducting line. In FIG. 1C, the carbon black particles 12 are above the percolation threshold, and may form multiple conducting lines.

Based on the foregoing, one may calculate the PL of the carbon black in the packed liquid ink layer in the examples above. It is well known that the solids concentration in the liquid packed toner (developed layer) is above 25%. This means that 65% PL of carbon black in solids will be above 16% in the packed ink layer (including an insulating paraffinic liquid, such as ISOPAR®, in the media of the packed layer. This is close to above the percolation threshold and hence, the packed layer is conductive with the discharge phenomenon in a liquid electrophotographic apparatus, such as described below.

Figure 2:
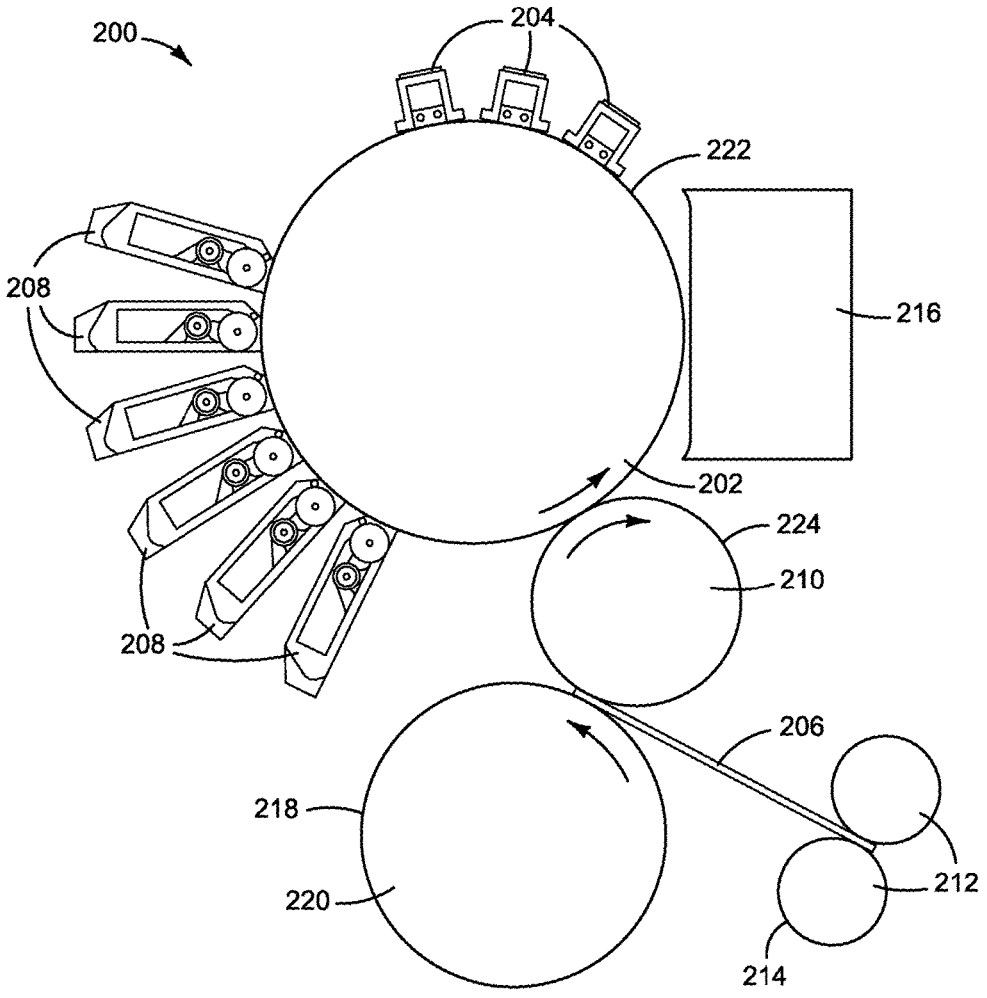
FIG. 2 is a schematic depiction of a LEP printer using the carbon nanotube-based electroink disclosed herein, according to an example.

Referring now to FIG. 2, an example liquid electrophotographic (LEP) print engine 200 is shown in accordance with the teachings of this disclosure. It is noted that the elements of FIG. 2 are not necessarily drawn to scale, nor does it represent every LEP design available for use herein, i.e. it provides merely an example of an LEP printing system that may use an electroink containing carbon nanotubes or metal flakes or fibers. In this example, the LEP print engine 200 can form a latent image on a photo imaging plate (PIP) 202 by charging at least a portion of the PIP with charging units 204. The charging mechanism can include one or multiple unit charging subunit (not shown) followed by a laser discharging unit (not shown). Typically, the charging of the PIP corresponds to an image which can be printed by the LEP printing engine on a substrate 206. The latent image can be developed by liquid toner/liquid electrophotographic ink from binary image developers (BID) 208. The liquid electrophotographic ink adheres to the appropriately charged areas of the PIP developing the latent image, thereby forming a developed image. The developed image can be transferred to an intermediate transfer member (ITM), or blanket, 210. Additionally, the developed image can be heated on the ITM. The developed image can then be transferred to the substrate 206 as described herein.

Prior to transferring the developed image to the substrate 206, the substrate may be guided by rollers 212, as well as being pretreated to condition the surface thereof, if desired.

The PIP 202 can be optionally discharged and cleaned by a cleaning/discharging unit 216 prior to recharging of the PIP in order to start another printing cycle. As the substrate passes by the ITM 210, the developed image located on the ITM can then be transferred to the substrate 206. Affixation of the developed image to the substrate 206 can be facilitated by locating the substrate on the surface 218 of impression roller 220, which can apply pressure to the substrate by compressing it between the impression roller and the ITM 210 as the image is being transferred to the substrate. Eventually, the substrate 206 bearing the image exits the printer 200. In one example, the printer can be a sheet-fed printer. In another example, the printer can be a web-fed printer. In the context of printing electrically conducting ink, as disclosed herein, the substrate may be a printed circuit board or other suitable substrate for receiving conductive traces.

FIG. 2 shows a plurality of BID units 208 located on the PIP 202. In one example, each BID can contain a different colored liquid electrophotographic ink, for use in producing multi-color images. Generally, a colored liquid electrophotographic ink can be located in each of the other BID units. The present LEP printer 200 can be a one-shot process printer that transfers a complete multi-color image to the substrate at one time. Alternatively, the LEP printer 200 can transfer each colored liquid electrophotographic ink to the substrate 206 sequentially. In another example, particularly useful for printing conductive traces, only one BID unit 208 may be present.

In accordance with the teachings herein, a liquid toner, or ink, made of resin and an electrically conducting material, such as conductive CNT (carbon nanotubes) pigment, is provided. The ink formulation may be used for printing conductive traces with LEP (liquid electrophotography), using, as an example, an LEP printer 200, such as shown in FIG. 2. The disclosed ink formulation may give improved results in terms of higher electrical conductivity of the printed traces, as depicted, for example, in FIG. 7, discussed below. The improved formulation may be based on improved dispersability of the pigment in the binding resin. The improved dispersability may be the result of employing the disclosed pigment accompanied with a dispersing agent. The desired conductivity may be achieved with printing multiple layers, at least up to sixteen layers. Heat cure can also support high solid film conductivity.

The conductive liquid toner disclosed herein may be used for rapid prototyping of circuit traces, or, for that matter, the circuit traces themselves, such as on printed circuit boards. For example, the conductive liquid toner may be used to create conductive patterns for electrical circuits and conductive electrodes such as used in active matrix TFTs (Thin-Film Transistors). While the electrical conductivity with CNT is not high enough for applications such as active electronic devices, the conductive liquid toner containing CNT may be suitably employed for electrodes for capacitive devices, charge storage devices, electroluminescent devices, and logic devices.

The liquid electrophotographic inks or liquid toners described herein may contain carbon nanotubes or other conducting material, such as metal flakes or fibers or other low symmetry electrically conducting materials as "pigment", or colorant. Generally, liquid electrophotographic inks can include a pigment, one or more polymers, or resins, a dispersant, and a liquid vehicle, or carrier. Additionally, other additives may be present in the liquid toner. One or more non-ionic, cationic, and/or anionic surfactants, or dispersant, can be present, ranging from 0 to about 50 wt %. Further, a charging component may be present. The balance of the formulation can be other liquid vehicle components known in the art, such as biocides, organic solvents, viscosity modifiers, and materials for pH adjustment, sequestering agents, preservatives, compatibility additives, emulsifiers, and the like.

Electrically Conducting Material:

The electrically conducting material, also sometimes referred to herein as the pigment or colorant, may be a relatively low symmetry, electrically conducting material, such as a carbon-based material or metallic flakes or metal nano-fibers. By relatively low symmetry is meant in comparison to relatively high symmetry shapes, such as spheres and cubes, in which examples of low symmetry shapes include flakes, fibers, and tubes.

Specific examples of carbon-based low symmetry conducting materials include, but are not limited to, carbon nanotubes and graphene. Examples of metals employed as flakes and nano-fibers include, but are not limited to, aluminum, tin, transition metals, and alloys thereof. The transition metal may be any of, for example, zinc, copper, silver, gold, nickel, palladium, platinum, chromium, and iron. Alloys that may be used include, but are not limited to, brass, bronze, and steel.

In some examples, carbon nanotubes may be used. For example, the carbon nanotubes may be short (0.5 to 2 micrometer length) and multi-walled, with 3 to 5 nm inside diameter and 8 to 15 nm outer diameter. Carbon nanotubes have a lower percolation threshold level due to the lower symmetry (high 3D aspect ratio) as the fillers. In the solid film, the nanotubes rods are aligned to give conductive lines with low concentration compared to higher symmetrical fillers pigment such as carbon black pigment. However, before the film forming of the ink on the hot surface of the blanket 210, the randomly distribution of the nanotubes rods is an advantage for low percolation as illustrated in and discussed with reference to FIGS. 3A-3E below. With the particles dispersed in the carrier liquid, creating continuous conductive lines is much easier, due to the lower percolation level, giving a wider operating voltage window in the development unit 208 on the LEP press 200.

Resin:

The electrostatic ink composition may include chargeable particles that form a resin, which may be a thermoplastic resin. A thermoplastic polymer is sometimes referred to as a thermoplastic resin. The resin may coat the conductive pigment, such that the particles include a core of conductive pigment, and have an outer layer of resin thereon. The outer layer of resin may coat the conductive pigment partially or completely.

The resin typically may be a polymer. The resin may be, but is not limited to, a thermoplastic polymer. In some examples, the polymer of the resin may be any of ethylene acrylic acid copolymers; ethylene methacrylic acid copolymers; ethylene vinyl acetate copolymers; copolymers of ethylene (e.g., 80 to 99.9 wt %), and alkyl (e.g., $C_1$ to $C_5$) ester of methacrylic or acrylic acid (e.g., 0.1 to 20 wt %); copolymers of ethylene (e.g., 80 to 99.9 wt %), acrylic or methacrylic acid (e.g., 0.1 to 20.0 wt %) and alkyl (e.g., $C_1$ to $C_5$) ester of methacrylic or acrylic acid (e.g., 0.1 to 20 wt %); polyethylene; polystyrene; isotactic polypropylene (crystalline); ethylene ethyl acrylate; polyesters; polyvinyl toluene; polyamides; styrene/butadiene copolymers; epoxy resins; acrylic resins (e.g., copolymer of acrylic or methacrylic acid and at least one alkyl ester of acrylic or methacrylic acid wherein alkyl may be, in some examples, from 1 to about 20 carbon atoms, such as methyl methacrylate (e.g., 50 to 90 wt %)/methacrylic acid (e.g., 0 to 20 wt %)/ethylhexylacrylate (e.g., 10 to 50 wt %)); ethylene-acrylate terpolymers: ethylene-acrylic esters-maleic anhydride (MAH) or glycidyl methacrylate (GMA) terpolymers; ethylene-acrylic acid ionomers and combinations thereof.

The resin may be a polymer having acidic side groups. The polymer having acidic side groups may have an acidity of 50 mg KOH/g or more, in some examples an acidity of 60 mg KOH/g or more, in some examples an acidity of 70 mg KOH/g or more, in some examples an acidity of 80 mg KOH/g or more, in some examples an acidity of 90 mg KOH/g or more, in some examples an acidity of 100 mg KOH/g or more, in some examples an acidity of 105 mg KOH/g or more, in some examples 110 mg KOH/g or more, in some examples 115 mg KOH/g or more. The polymer having acidic side groups may have an acidity of 200 mg KOH/g or less, in some examples 190 mg or less, in some examples 180 mg or less, in some examples 130 mg KOH/g or less, in some examples 120 mg KOH/g or less. Acidity of a polymer, as measured in mg KOH/g can be measured using standard procedures known in the art, for example using the procedure described in ASTM D1386.

The resin may be a polymer, in some examples a polymer having acidic side groups, that has a melt flow rate of less than about 60 g/10 minutes, in some examples about 50 g/10 minutes or less, in some examples about 40 g/10 minutes or less, in some examples 30 g/10 minutes or less, in some examples 20 g/10 minutes or less, in some examples 10 g/10 minutes or less. In some examples, all polymers having acidic side groups and/or ester groups in the particles each individually have a melt flow rate of less than 90 g/10 minutes, 80 g/10 minutes or less, in some examples 80 g/10 minutes or less, in some examples 70 g/10 minutes or less, in some examples 70 g/10 minutes or less, in some examples 60 g/10 minutes or less.

The polymer having acidic side groups can have a melt flow rate of about 10 g/10 minutes to about 120 g/10 minutes, in some examples about 10 g/10 minutes to about 70 g/10 minutes, in some examples about 10 g/10 minutes to 40 g/10 minutes, in some examples 20 g/10 minutes to 30 g/10 minutes. The polymer having acidic side groups can have a melt flow rate of in some examples about 50 g/10 minutes to about 120 g/10 minutes, in some examples 60 g/10 minutes to about 100 g/10 minutes. The melt flow rate can be measured using standard procedures known in the art, for example as described in ASTM D1238.

The acidic side groups may be in free acid form or may be in the form of an anion and associated with one or more counterions, typically metal counterions, e.g., a metal selected from the alkali metals, such as lithium, sodium and potassium, alkali earth metals, such as magnesium or calcium, and transition metals, such as zinc. The polymer having acidic sides groups can be selected from resins such as copolymers of ethylene and an ethylenically unsaturated acid of either acrylic acid or methacrylic acid; and ionomers thereof, such as methacrylic acid and ethylene-acrylic or methacrylic acid copolymers which are at least partially neutralized with metal ions (e.g., Zn, Na, Li) such as SURLYN® ionomers. The polymer comprising acidic side groups can be a copolymer of ethylene and an ethylenically unsaturated acid of either acrylic or methacrylic acid, where the ethylenically unsaturated acid of either acrylic or methacrylic acid constitute from 5 wt % to about 25 wt % of the copolymer, in some examples from 10 wt % to about 20 wt % of the copolymer.

The resin may be two different polymers having acidic side groups. The two polymers having acidic side groups may have different acidities, which may fall within the ranges mentioned above. The resin may be a first polymer having acidic side groups that has an acidity of from 50 mg KOH/g to 110 mg KOH/g and a second polymer having acidic side groups that has an acidity of 110 mg KOH/g to 130 mg KOH/g.

The resin may be two different polymers having acidic side groups: a first polymer having acidic side groups that has a melt flow rate of about 10 to 50 g/10 minutes and an acidity of from about 50 to 110 mg KOH/g, and a second polymer having acidic side groups that has a melt flow rate of about 50 to 120 g/10 minutes and an acidity of about 110 to 130 mg KOH/g. The first and second polymers may be absent of ester groups.

The resin may be two different polymers having acidic side groups: a first polymer that is a copolymer of ethylene (e.g., 92 to 85 wt %, in some examples about 89 wt %) and acrylic or methacrylic acid (e.g., 8 to 15 wt %, in some examples about 11 wt %) having a melt flow rate of 80 to 110 g/10 minutes and a second polymer that is a co-polymer of ethylene (e.g., about 80 to 92 wt %, in some examples about 85 wt %) and acrylic acid (e.g., about 18 to 12 wt %, in some examples about 15 wt %), having a melt viscosity lower than that of the first polymer, the second polymer for example having a melt viscosity of 15000 poise or less, in some examples a melt viscosity of 10000 poise or less, in some examples 1000 poise or less, in some examples 100 poise or less, in some examples 50 poise or less, in some examples 10 poise or less. Melt viscosity can be measured using standard techniques. The melt viscosity can be measured using a rheometer, e.g., a commercially available AR-2000 Rheometer from Thermal Analysis Instruments, using the geometry of: 25 mm steel plate-standard steel parallel plate, and finding the plate over plate rheometry isotherm at 120° C., 0.01 Hz shear rate.

In any of the resins mentioned above, the ratio of the first polymer having acidic side groups to the second polymer having acidic side groups can be from about 10:1 to about 2:1. In another example, the ratio can be from about 6:1 to about 3:1, and in some examples about 4:1.

The resin may be a polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; the polymer may be a polymer having acidic side groups as described herein. The resin may include a first polymer having a melt viscosity of 15000 poise or more, in some examples 20000 poise or more, in some examples 50000 poise or more, in some examples 70000 poise or more; and in some examples, the resin may include a second polymer having a melt viscosity less than the first polymer, in some examples a melt viscosity of 15000 poise or less, in some examples a melt viscosity of 10000 poise or less, in some examples 1000 poise or less, in some examples 100 poise or less, in some examples 50 poise or less, in some examples 10 poise or less. The resin may include a first polymer having a melt viscosity of more than 60000 poise, in some examples from 60000 to 100000 poise, in some examples from 65000 to 85000 poise; a second polymer having a melt viscosity of from 15000 to 40000 poise, in some examples 20000 to 30000 poise, and a third polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; an example of the first polymer is Nucrel 960 (from DuPont), an example of the second polymer is Nucrel 699 (from DuPont), and an example of the third polymer is AC-5120 (from Honeywell). The first, second and third polymers may be polymers having acidic side groups as described herein. The melt viscosity can be measured using a rheometer, e.g., a commercially available AR-2000 Rheometer from Thermal Analysis Instruments, using the geometry of: 25 mm steel plate-standard steel parallel plate, and finding the plate over plate rheometry isotherm at 120° C., 0.01 Hz shear rate.

If the resin is a single type of resin polymer, the resin polymer (excluding any other components of the electrostatic ink composition) may have a melt viscosity of 6000 poise or more, in some examples a melt viscosity of 8000 poise or more, in some examples a melt viscosity of 10000 poise or more, in some examples a melt viscosity of 12000 poise or more. If the resin includes a plurality of polymers, all the polymers of the resin may together form a mixture (excluding any other components of the electrostatic ink composition) that has a melt viscosity of 6000 poise or more, in some examples a melt viscosity of 8000 poise or more, in some examples a melt viscosity of 10000 poise or more, in some examples a melt viscosity of 12000 poise or more. Melt viscosity can be measured using standard techniques. The melt viscosity can be measured using a rheometer, e.g., a commercially available AR-2000 Rheometer from Thermal Analysis Instruments, using the geometry of: 25 mm steel plate-standard steel parallel plate, and finding the plate over plate rheometry isotherm at 120° C., 0.01 Hz shear rate.

The resin may include two different polymers having acidic side groups that are selected from copolymers of ethylene and an ethylenically unsaturated acid of either methacrylic acid or acrylic acid; and ionomers thereof, such as methacrylic acid and ethylene-acrylic or methacrylic acid copolymers which are at least partially neutralized with metal ions (e.g., Zn, Na, and Li) such as SURLYN® ionomers. The resin may include (i) a first polymer that is a copolymer of ethylene and an ethylenically unsaturated acid of either acrylic acid and methacrylic acid, wherein the ethylenically unsaturated acid of either acrylic or methacrylic acid constitutes from about 8 to 16 wt % of the copolymer, in some examples from about 10 to 16 wt % of the copolymer; and (ii) a second polymer that is a copolymer of ethylene and an ethylenically unsaturated acid of either acrylic acid and methacrylic acid, wherein the ethylenically unsaturated acid of either acrylic or methacrylic acid constitutes from about 12 to 30 wt % of the copolymer, in some examples from about 14 to 20 wt % of the copolymer, in some examples from about 16 to 20 wt % of the copolymer, and in some examples from about 17 to 19 wt % of the copolymer.

In an example, the resin may constitute about 5 to 90 wt %, and in some examples, about 5 to 80 wt % of the solids of the electrostatic ink composition. In another example, the resin may constitute about 10 to 60 wt % of the solids of the electrostatic ink composition. In another example, the resin may constitute about 15 to 40 wt % of the solids of the electrostatic ink composition. In another example, the resin may constitute about 60 to 95 wt %, and in some examples, from 80 to 90 wt % of the solids of the electrostatic ink composition.

The resin may include a polymer having acidic side groups, as described above (which may be free of ester side groups), and a polymer having ester side groups. The polymer having ester side groups is, in some examples, a thermoplastic polymer. The polymer having ester side groups may further include acidic side groups. The polymer having ester side groups may be a copolymer of a monomer having ester side groups and a monomer having acidic side groups. The polymer may be a co-polymer of a monomer having ester side groups, a monomer having acidic side groups, and a monomer absent of any acidic and ester side groups. The monomer having ester side groups may be a monomer selected from esterified acrylic acid or esterified methacrylic acid. The monomer having acidic side groups may be a monomer selected from acrylic or methacrylic acid. The monomer absent of any acidic and ester side groups may be an alkylene monomer, including, but not limited to, ethylene or propylene. The esterified acrylic acid or esterified methacrylic acid may, respectively, be an alkyl ester of acrylic acid or an alkyl ester of methacrylic acid. The alkyl group in the alkyl ester of acrylic or methacrylic acid may be an alkyl group having 1 to 30 carbons, in some examples 1 to 20 carbons, and in some examples 1 to 10 carbons. In some examples, the alkyl group may be selected from methyl, ethyl, iso-propyl, n-propyl, t-butyl, iso-butyl, n-butyl and pentyl.

The polymer having ester side groups may be a co-polymer of a first monomer having ester side groups, a second monomer having acidic side groups and a third monomer which is an alkylene monomer absent of any acidic and ester side groups. The polymer having ester side groups may be a co-polymer of (i) a first monomer having ester side groups selected from esterified acrylic acid or esterified methacrylic acid, in some examples an alkyl ester of acrylic or methacrylic acid, (ii) a second monomer having acidic side groups selected from acrylic or methacrylic acid and (iii) a third monomer which is an alkylene monomer selected from ethylene and propylene. The first monomer may constitute about 1 to 50 wt % of the co-polymer, in some examples about 5 to 40 wt %, in some examples about 5 to 20 wt % of the copolymer, in some examples about 5 to 15 wt % of the copolymer. The second monomer may constitute about 1 to 50 wt % of the co-polymer, in some examples about 5 to 40 wt % of the copolymer, in some examples about 5 to 20 wt % of the co-polymer, in some examples about 5 to 15 wt % of the copolymer. In an example, the first monomer may constitute about 5 to 40 wt % of the co-polymer, the second monomer may constitute about 5 to 40 wt % of the co-polymer, with the third monomer constituting the remaining weight of the copolymer. In an example, the first monomer may constitute about 5 to 15 wt % of the co-polymer, the second monomer may constitute about 5 to 15 wt % of the co-polymer, with the third monomer constituting the remaining weight of the copolymer. In an example, the first monomer may constitute about 8 to 12 wt % of the co-polymer, the second monomer may constitute about 8 to 12 wt % of the co-polymer, with the third monomer constituting the remaining weight of the copolymer. In an example, the first monomer may constitute about 10 wt % of the co-polymer, the second monomer may constitute about 10 wt % of the co-polymer, with the third monomer constituting the remaining weight of the copolymer. The polymer having ester side groups may be selected from the Bynel® class of monomers, including Bynel® 2022 and Bynel® 2002, which are available from DuPont.

The polymer having ester side groups may constitute about 1 wt % or more of the total amount of the resin polymers in the resin, e.g., the total amount of the polymer or polymers having acidic side groups and polymer having ester side groups. The polymer having ester side groups may constitute about 5 wt % or more of the total amount of the resin polymers in the resin, in some examples about 8 wt % or more of the total amount of the resin polymers in the resin, in some examples about 10 wt % or more of the total amount of the resin polymers in the resin, in some examples about 15 wt % or more of the total amount of the resin polymers in the resin, in some examples about 20 wt % or more of the total amount of the resin polymers in the resin, in some examples about 25 wt % or more of the total amount of the resin polymers in the resin, in some examples about 30 wt % or more of the total amount of the resin polymers in the resin, and in some examples about 35 wt % or more of the total amount of the resin polymers in the resin. The polymer having ester side groups may constitute from about 5 to 50 wt % of the total amount of the resin polymers in the resin, in some examples about 10 to 40 wt % of the total amount of the resin polymers in the resin, and in some examples about 15 to 30 wt % of the total amount of the polymers in the resin.

The polymer having ester side groups may have an acidity of about 50 mg KOH/g or more, in some examples an acidity of about 60 mg KOH/g or more, in some examples an acidity of about 70 mg KOH/g or more, and in some examples an acidity of about 80 mg KOH/g or more. The polymer having ester side groups may have an acidity of about 100 mg KOH/g or less, and in some examples about 90 mg KOH/g or less. The polymer having ester side groups may have an acidity of about 60 mg to 90 mg KOH/g, and in some examples about 70 mg to 80 mg KOH/g.

The polymer having ester side groups may have a melt flow rate of about 10 to 120 g/10 minutes, in some examples about 10 to 50 g/10 minutes, in some examples about 20 to 40 g/10 minutes, and in some examples about 25 to 35 g/10 minutes.

In some examples, the polymer or polymers of the resin can be selected from the Nucrel family of toners (e.g., Nucrel 403™, Nucrel 407™, Nucrel 609HS™, Nucrel 908HS™, Nucrel 1202HC™, Nucrel 30707™, Nucrel 1214™, Nucrel 903™, Nucrel 3990™, Nucrel 910™, Nucrel 925™, Nucrel 699™, Nucrel 599™, Nucrel 960™, Nucrel RX 76™, Nucrel 2806™, Bynel® 2002, Bynel® 2014, and Bynel® 2020 (sold by E. I. du PONT)), the AClyn® family of toners (e.g., AClyn® 201, AClyn® 246, AClyn® 285, and AClyn® 295 (sold by Honeywell), and the Lotader® family of toners (e.g., Lotader® 2210, Lotader® 3430, and Lotader® 8200 (sold by Arkema)).

In other examples, a mix of two copolymers, such as F/ACE, may be employed, where F is Nucrel 699 (DuPont) and ACE is AC 5120 (Honeywell).

Dispersants:

The dispersant, or surfactant, may be soluble in the liquid carrier. The surfactant may be an oil-soluble surfactant. The surfactant may be a surfactant soluble in a hydrocarbon liquid carrier.

In some examples, the surfactant may be any of anionic surfactant, cationic surfactant, amphoteric surfactant, non-ionic surfactant, polymeric surfactant, oligomeric surfactant, crosslinking surfactant, or combinations thereof.

The anionic surfactant may be sulfosuccinic acid and derivatives thereof such as, for instance, alkyl sulfosuccinates (e.g., GEROPON® SBFA-30 and GEROPON® SSO-75, both of which are manufactured by Rhodia, Boulogne-Billancourt, France) and docusate sodium.

The cationic surfactant may be any of quaternary amine polymers, protonated amine polymers, and polymers containing aluminum (such as those that are available from Lubrizol Corp., Wickliffe, Ohio). Further examples of cationic surfactants include SOLSPERSE® 2155, 9000, 13650, 13940, and 19000 (Lubrizol Corp.) and other like cationic surfactants.

The amphoteric surfactant may be any of surfactants that contain compounds having protonizable groups and/or ionizable acid groups. An example of a suitable amphoteric surfactant includes lecithin.

The non-ionic surfactant may be any of oil-soluble polyesters, polyamines, polyacrylates, polymethacrylates (such as, e.g., SOLSPERSE® 3000 (Lubrizol Corp.), SOLSPERSE® 21000 (Lubrizol Corp.), or the like.

The oligomeric surfactant may be any of low average molecular weight (i.e., less than 1000) non-ionic surfactants.

The cross-linking surfactant may be any of polymers or oligomers containing two or more carbon double bonds (C=C) and/or free amine groups such as, e.g., polyamines, crosslinkable polyurethanes, and divinyl benzene.

Other suitable surfactants may include OS#13309AP, OS#13309AQ, 14179BL, and 45479AB from Lubrizol Corp, which are surfactants based on polyisobutylene succinic acid with polyethyleneimines. These surfactants are combination polymers that are cationic in nature.

Surfactants typically may have a head group and a tail group, with the head group and tail group typically of different polarity, e.g., the head group being polar and the tail group being relatively non-polar compared to the head group. The surfactant may have an acidic head group, e.g., a head group that is a carboxylic acid. The surfactant may have a basic head group. Basic head groups have been found to be more efficacious than acid head groups, particularly in the final appearance of the printed ink. The basic head group may be an amine group, which may be any of a primary amine group and a secondary amine group. The basic head group may be a plurality of amine groups, which may each independently be any of a primary amine group and a secondary amine group.

In some examples, the surfactant may be a succinamide. The succinamide may be linked, e.g., via a hydrocarbon-containing linker group, to an amine group. In some examples, the surfactant may be a polyisobutylene succinamide having a head group comprising an amine.

In some examples, the surfactant may be of Formula (I)

Formula (I)

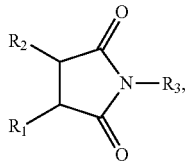

wherein $R_1$, $R_2$ and $R_3$ may be any of an amine-containing head group, a hydrocarbon tail group and hydrogen, wherein at least one of $R_1$, $R_2$ and $R_3$ has a hydrocarbon tail group, and wherein at least one of $R_1$, $R_2$ and $R_3$ has an amine-containing head group.

In some examples, $R_1$ and $R_2$ may be any of a hydrocarbon tail group and hydrogen, with at least one of $R_1$ and $R_2$ being a hydrocarbon tail group, and $R_3$ is an amine-containing head group. The hydrocarbon tail group may be a hydrocarbon group, which may be branched or straight chain and may be unsubstituted. The hydrocarbon tail group may be a hydrocarbon group containing a polyalkylene, which may be any of a polyethylene, polypropylene, or polybutylene. In some examples, the hydrocarbon tail group may contain a polyisobutylene. The hydrocarbon tail group may contain from 10 to 100 carbons, from 10 to 50 carbons, or from 10 to 30 carbons. The hydrocarbon tail group may be of the Formula (II):

$$\text{P-L-} \qquad \text{Formula (II)},$$

wherein P may be polyisobutylene and L may be any of a single bond, $(CH_2)_n$, wherein n is from 0 to 5 or from 1 to 5, —O— and —NH—.

In some examples, the amine-containing head group may be a hydrocarbon group having an amine group attached to one of the carbons of the hydrocarbon group. In some examples, the amine-containing head group may be of the Formula (III)

$$(CH_2)_m[(CH_2)_oNH(CH_2)_p]_q(CH_2)_r—NH_2 \qquad \text{Formula (III)},$$

wherein m is at least 1 or from 1 to 5, q is 0 to 10, o is 0, 1 or 2, p is 1 or 2, and r is 0 to 10. In some examples, m is 1, o is 1, p is 1 and q is from 0 to 10 or from 1 to 5, and r is 1 to 5. In some examples m is 1, q is 0 to 10 or from 1 to 10 or from 1 to 5, o is 1, p is 1, and r is 1.

In some examples, the surfactant may be of formula (I), wherein $R_1$ is of formula (II), $R_2$ is H and $R_3$ is of formula (III). In some examples, the surfactant may be of formula (I), wherein $R_1$ is of formula (II), wherein L is —$CH_2$—, $R_2$ is H and $R_3$ is of formula (III), wherein m is 1, q is 0 to 10 or from 1 to 10 or from 1 to 5, o is 1, p is 1 and r is 1.

The coating of the surfactant on the conductive pigment may be produced using any suitable method. For example, the coating of the surfactant on the conductive pigment may be produced by contacting the conductive pigment not having a coating of surfactant thereon with the surfactant, which, in some examples, may be in a liquid medium. In some examples, the conductive pigment having a coating of surfactant thereon may be produced by contacting a conductive pigment not having a coating of surfactant thereon with a liquid medium containing the surfactant until a coating of the surfactant is formed on the conductive metallic pigment. The liquid medium may contain at least 1 wt % of the surfactant, before contacting with the conductive metallic pigment. The liquid medium may contain at least 2 wt %, in some examples at least 3 wt %, in some examples at least 4 wt %, and in some examples at least 5 wt %, of the surfactant before contacting with the conductive metallic pigment. The liquid medium may contain 20 wt % or less of the surfactant, before contacting with the conductive pigment. The liquid medium may contain 15 wt % or less of the surfactant, before contacting with the conductive pigment. The liquid medium may contain from 2 to 10 wt % of the surfactant, before contacting with the conductive pigment. After contacting of the surfactant with the conductive pigment and during coating of the surfactant on the conductive pigment, the mixture may be at least 10 wt % conductive pigment, in some examples at least 20 wt % conductive pigment, in some examples from 10 to 50 wt % conductive pigment, in some examples 20 to 40 wt % conductive pigment, and in some examples 25 to 25 wt % conductive pigment. In some examples, the liquid medium may be of the same type as the liquid carrier. In some examples, the liquid medium may be a hydrocarbon liquid.

In some examples, the dispersant may be SOLSPERSE® J560.

Charge Director:

The electrostatic ink composition may include a charge director comprising a sulfosuccinate salt of the general formula MAn, wherein M is a metal, n is the valence of M, and A is an ion of the general formula (IV):

$$[R^1—O—C(O)CH_2CH(SO_3)C(O)—O—R^2]^- \qquad \text{Formula (IV)}$$

wherein each of $R^1$ and $R^2$ is an alkyl group.

The charge director may be added in order to impart and/or maintain sufficient electrostatic charge on the ink particles, which may be particles comprising the pigment, the resin and the dispersant.

The sulfosuccinate salt of the general formula MAn is an example of a micelle-forming salt. The charge director may be substantially free or free of an acid of the general formula HA, where A is as described above. The charge director may include micelles of the sulfosuccinate salt enclosing at least some of the nanoparticles. The charge director may include at least some nanoparticles having a size of 200 nm or less, and in some examples 2 nm or more.

The charge director may further include a simple salt. Simple salts are salts that do not form micelles by themselves, although they may form a core for micelles with a micelle-forming salt. The ions constructing the simple salts are all hydrophilic. The simple salt may include a cation selected from Mg, Ca, Ba, $NH_4$, tert-butyl ammonium, $Li^+$, and $Al^{+3}$, or from any sub-group thereof. The simple salt may include an anion selected from $SO_4^{2-}$, $PO^{3-}$, $NO^{3-}$, $HPO_4^{2-}$, $CO_3^{2-}$, acetate, trifluoroacetate (TFA), $Cl^-$, $BF_4^-$, $F^-$, $ClO_4^-$, and $TiO_3^{4-}$, or from any sub-group thereof. The simple salt may be selected from $CaCO_3$, $Ba_2TiO_3$, $Al_2(SO_4)$, $Al(NO_3)_3$, $Ca_3(PO_4)_2$, $BaSO_4$, $BaHPO_4$, $Ba_2(PO_4)_3$, $CaSO_4$, $(NH_4)_2CO_3$, $(NH_4)_2SO_4$, $NH_4OAc$, tert-butyl ammonium bromide, $NH_4NO_3$, LiTFA, $Al_2(SO_4)3$, $LiClO_4$ and $LiBF_4$, or any sub-group thereof. The charge director may further include basic barium petronate (BBP).

In the formula $[R_1—O—C(O)CH_2CH(SO_3^-)C(O)—O—R_2]$, in some examples, each of $R^1$ and $R^2$ may be an aliphatic alkyl group. In some examples, each of $R^1$ and $R^2$ independently may be a $C_6$ to $C_{25}$ alkyl. In some examples, the aliphatic alkyl group may be linear. In some examples, the aliphatic alkyl group may be branched. In some examples, the aliphatic alkyl group may include a linear chain of more than 6 carbon atoms. In some examples, $R^1$ and $R^2$ may be the same. In some examples, at least one of $R^1$ and $R^2$ may be $C_{13}H_{27}$. In some examples, M may be Na, K, Cs, Ca, or Ba.

The charge director may further include one of, some of, or all of (i) soya lecithin, (ii) a barium sulfonate salt, such as basic barium petronate (BPP), or (iii) an isopropyl amine sulfonate salt. Basic barium petronate is a barium sulfonate salt of a $C_{21}$ to $C_{26}$ hydrocarbon alkyl, and can be obtained, for example, from Chemtura. An example isopropyl amine sulfonate salt is dodecyl benzene sulfonic acid isopropyl amine, which is available from Croda. In one specific non-limiting example, the charge director may be a mixture of soya lecithin at 6.6 wt %, BBP at 9.8 wt %, isopropyl amine dodecylbenzene sulfonic acid at 3.6 wt %, and about 80 wt % isoparaffin, such as ISOPAR®.

In some examples, the charge director may constitute about 0.001 to 20% wt %, in some examples about 0.01 to 20 wt %, in some examples about 0.01 to 10 wt %, and in some examples about 0.01 to 1 wt % of the solids of an electrostatic ink composition. In some examples, the charge director may constitute about 0.001 to 0.15 wt % of the solids of the electrostatic ink composition, in some examples about 0.001 to 0.15 wt %, in some examples about 0.001 to 0.02 wt % of the solids of an electrostatic ink composition, in some examples about 0.1 to 2 wt % of the solids of the electrostatic ink composition, in some examples about 0.2 to 1.5 wt % of the solids of the electrostatic ink composition, in some examples about 0.1 to 1 wt % of the solids of the electrostatic ink composition, and in some examples about 0.2 to 0.8 wt % of the solids of the electrostatic ink composition. In some examples, the charge director may be present in an amount of at least 1 mg of charge director per gram of solids of the electrostatic ink composition (which will be abbreviated to mg/g), in some examples at least 2 mg/g, in some examples at least 3 mg/g, in some examples at least 4 mg/g, and in some examples at least 5 mg/g. In some examples, the moderate acid may be present in the amounts stated above, and the charge director may be present in an amount of from about 1 to 50 mg/g of charge director per gram of solids of the electrostatic ink composition, in some examples from about 1 to 25 mg/g, in some examples from about 1 to 20 mg/g, in some examples from about 1 to 15 mg/g, in some examples from about 1 to 10 mg/g, in some examples from about 3 to 20 mg/g, in some examples from about 3 to 15 mg/g, and in some examples from about 5 to 10 mg/g.

The electrostatic ink composition may further include a charge adjuvant. A charge adjuvant may promote charging of the particles when a charge director is present. The method as described here may involve adding a charge adjuvant at any stage. The charge adjuvant can include, but is not limited to, barium petronate, calcium petronate, Co salts of naphthenic acid, Ca salts of naphthenic acid, Cu salts of naphthenic acid, Mn salts of naphthenic acid, Ni salts of naphthenic acid, Zn salts of naphthenic acid, Fe salts of naphthenic acid, Ba salts of stearic acid, Co salts of stearic acid, Pb salts of stearic acid, Zn salts of stearic acid, Al salts of stearic acid, Zn salts of stearic acid, Cu salts of stearic acid, Pb salts of stearic acid, Fe salts of stearic acid, metal carboxylates (e.g., Al tristearate, Al octanoate, Li heptanoate, Fe stearate, Fe di-stearate, Ba stearate, Cr stearate, Mg octanoate, Ca stearate, Fe naphthenate, Zn naphthenate, Mn heptanoate, Zn heptanoate, Ba octanoate, Al octanoate, Co octanoate, Mn octanoate, and Zn octanoate), Co lineolates, Mn lineolates, Pb lineolates, Zn lineolates, Ca oleates, Co oleates, Zn palmirate, Ca resinates, Co resinates, Mn resinates, Pb resinates, Zn resinates, AB diblock copolymers of 2-ethylhexyl methacrylate-co-methacrylic acid calcium and ammonium salts, copolymers of an alkyl acrylamidoglycolate alkyl ether (e.g., methyl acrylamidoglycolate methyl ether-co-vinyl acetate), and hydroxy bis(3,5-di-tert-butyl salicylic) aluminate monohydrate. In an example, the charge adjuvant may be or may include aluminum di- or tri-stearate. The charge adjuvant may be present in an amount of about 0.1 to 5 wt % of the solids of the electrostatic ink composition, in some examples about 0.1 to 1 wt %, in some examples about 0.3 to 0.8 wt %, in some examples about 1 to 3 wt %, and in some examples about 1.5 to 2.5 wt %.

In some examples, the electrostatic ink composition further may include, e.g., as a charge adjuvant, a salt of multivalent cation and a fatty acid anion. The salt of multivalent cation and a fatty acid anion can act as a charge adjuvant. The multivalent cation may, in some examples, be a divalent or a trivalent cation. In some examples, the multivalent cation may be selected from Group 2, transition metals and Group 3 and Group 4 in the Periodic Table. In some examples, the multivalent cation may include a metal selected from Ca, Sc, Ti, V, Cr, Mn, Fe, Co, Ni, Cu, Zn, Al, and Pb. In some examples, the multivalent cation may be $Al^{3+}$. The fatty acid anion may be selected from a saturated or unsaturated fatty acid anion. The fatty acid anion may be selected from a $C_8$ to $C_{26}$ fatty acid anion, in some examples a $C_{14}$ to $C_{22}$ fatty acid anion, in some examples a $C_{16}$ to $C_{20}$ fatty acid anion, and in some examples a $C_{17}$, $C_{18}$ or $C_{19}$ fatty acid anion. In some examples, the fatty acid anion may be selected from a caprylic acid anion, capric acid anion, lauric acid anion, myristic acid anion, palmitic acid anion, stearic acid anion, arachidic acid anion, behenic acid anion, and cerotic acid anion.

The charge adjuvant, which may be or may include, for example, a salt of multivalent cation and a fatty acid anion, may be present in an amount of about 0.1 to 5 wt % of the solids of the electrostatic ink composition, in some examples in an amount of about 0.1 to 2 wt %, in some examples in an amount of about 0.1 to 2 wt %, in some examples in an amount of about 0.3 to 1.5 wt %, in some examples in an amount of about 0.5 to 1.2 wt %, in some examples in an amount of about 0.8 to 1 wt %, in some examples in an amount of about 1 to 3 wt % of the solids of the electrostatic ink composition, and in some examples in an amount of about 1.5 to 2.5 wt % of the solids of the electrostatic ink composition.

Liquid Vehicle:

Generally, the liquid electrophotographic ink may include a carrier fluid such as an aliphatic hydrocarbon including substituted or unsubstituted, linear or branched, aliphatic compounds. Additionally, such hydrocarbons can include aryl substituents. In one example, the aliphatic hydrocarbons may be substantially non-aqueous, i.e. containing less than 0.5 wt % water. In another example, the aliphatic hydrocarbons may be non-aqueous, i.e. containing no water. The aliphatic hydrocarbons may be any of paraffins, isoparaffins, oils, and alkanes having from about 6 to about 100 carbon atoms, and mixtures thereof.

In particular, the aliphatic hydrocarbons, or carrier fluid, can be one or more isoparaffins, such as or equivalent to the ISOPAR® high-purity isoparaffinic solvents with narrow boiling ranges marketed by Exxon Mobil Corporation. Also suitable as an aliphatic solvent or co-solvent, for implementing examples of the present disclosure are alkanes having from about 6 to about 14 carbon atoms such as solvents sold under the NORPAR® (NORPAR® 12, 13 and 15) trade name available from Exxon Mobil Corporation. Other hydrocarbons for use as an aliphatic solvent, or co-solvent, are sold under the AMSCO® (AMSCO® 460 and OMS) trade name available from American Mineral Spirits Company, under the SOLTROL® trade name available from Chevron Phillips Chemical Company LLC and under the SHELLSOL® trade name available from Shell Chemicals Limited. Such an aliphatic solvent, or co-solvent, may have desirable properties such as low odor, lack of color, selective solvency, good oxidation stability, low electrical conductivity, low skin irritation, low surface tension, superior spreadability, narrow boiling point range, non-corrosive to metals, low freeze point, high electrical resistivity, low surface tension, low latent heat of vaporization and low photochemical reactivity.

Compositions:

A suitable solids concentration range may include:

| | |
|---|---|
| pigment | 5 to 65 wt %; |
| resin | 5 to 90 wt %; |
| dispersant | 0 to 50 wt %; |
| charge director | 0.001 to 20 wt %; and |
| charge adjuvant | 0 to 10 wt %. |

In some examples, the pigment may be present within a range of about 30 to 45 wt %. In some examples, a charge adjuvant may be present.

An example solids concentration may include:

| | |
|---|---|
| CNT pigment* | 30 wt %; |
| F/ACE resin | 58 wt %; |
| SOLSPERSE ® J560 (dispersant) | 10 wt %; and |
| Al-di-stearate (charge adjuvant) | 2 wt %. |

*The resin concentration may be adjusted by the pigment concentration while Al-di-stearate and J560 remain constant.

In preparing the ink for printing in the LEP press, 0.5 to 8 wt % solids may be combined with the carrier, e.g., ISOPAR®. The charge director may be added at this time. For example, 2 wt % (based on the final ink composition) of NCD mixture (a combination of soya lecithin, BBP, and isopropyl amine dodecylbenzene sulfonic acid) may be added to the solids and carrier.

It may be appreciated that the printed conductive films need not necessarily be transparent, but may be opaque. This means that higher CNT concentrations in the ink, which would result in an opaque film, may be used. Higher concentrations of CNT in the ink may result in a higher electrically conductive film. Accordingly, relatively high pigment loading (PL) of solids on the order of 30 to 45% or even with a wider range of 5 to 65% may be employed.

Carbon Nanotubes:

Carbon nanotubes may have a lower percolation threshold level due to the lower symmetry (high 3D aspect ratio) as the filler. In the solid film, the nanotubes rods may be aligned to give conductive lines with lower concentration compared to higher symmetrical filler pigments such as carbon black pigment. However, before the film forming of the ink on the hot surface of the blanket 210, the randomly distribution of the nanotubes rods is an advantage for low percolation as illustrated in FIGS. 3A-3E. With the CNT particles 312 dispersed in the carrier liquid 310, creating conductive lines is much easier, thereby giving a wider operating voltage window in the development unit on the LEP press 200.

Figure 3A:
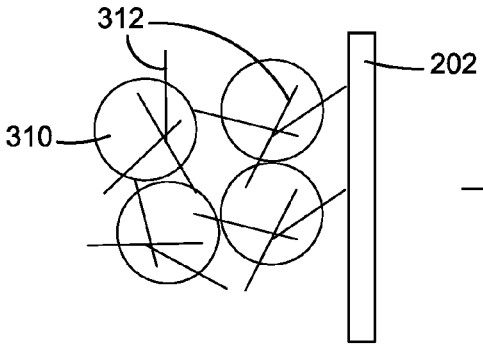
FIGS. 3A-3E are a series of schematic drawings, depicting a mechanism for creating a conductive print using LEP from randomly dispersed CNT composite particles in the carrier liquid to assembled CNT in the solid film under the fusing heat, according to an example.
Figure 3B:
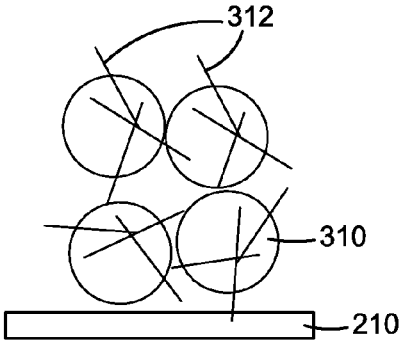
Figure 3C:
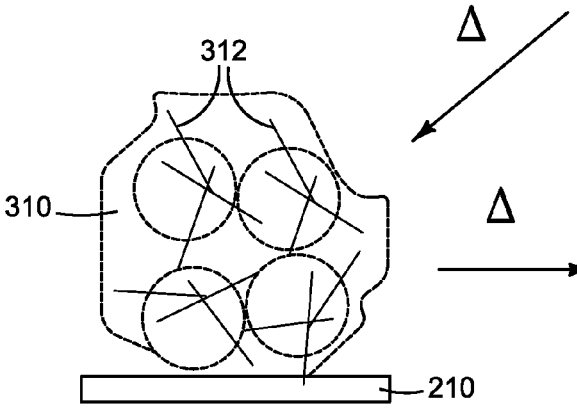
Figure 3D:
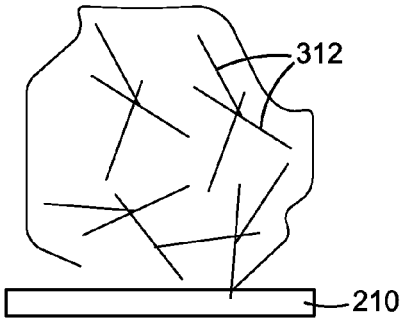
Figure 3E:
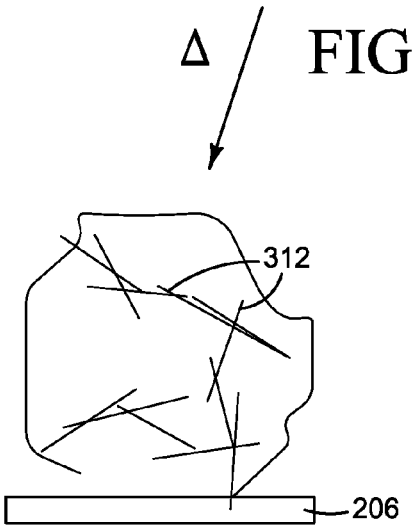

FIG. 3A schematically depicts carbon nanotube particles 312 in a liquid carrier 310 packed on the PIP, or developer roll, 202. In FIG. 3A, the carbon nanotube particles 312 in the liquid carrier 310 are transferred to the blanket 210. Upon heating (Δ), the liquid carrier is in the process of evaporating, and the carbon nanotube particles fused on the hot blanket 210, as shown in FIG. 3C. Upon further heating, a fused film is formed on the hot blanket 210, as shown in FIG. 3D. Finally, upon transfer to the substrate 206 and further heating, the carbon nanotube particles 310 fuse and align to give percolated conductive lines, as shown in FIG. 3E.

Figure 4:
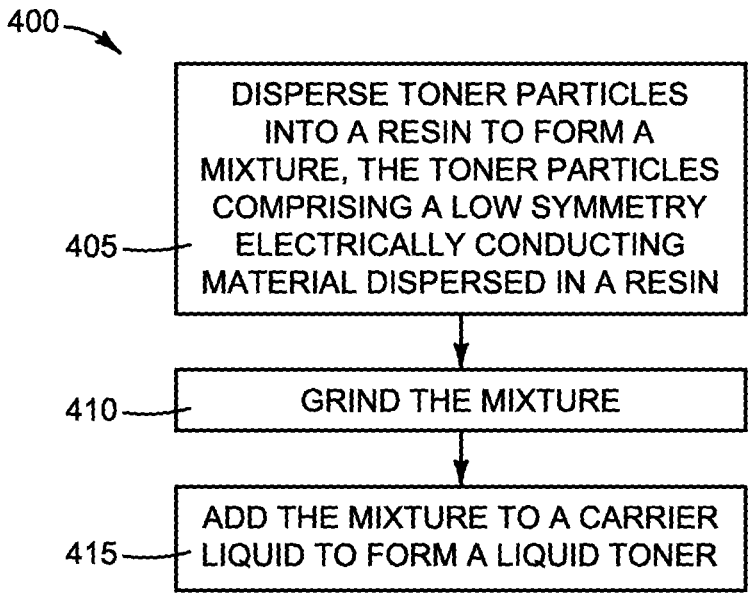
FIG. 4 is a flow chart, depicting a method of manufacturing a liquid toner for printing conductive traces, according to an example.

Manufacture of and Printing the Liquid Toner:

FIG. 4 is a flow chart depicting a method 400 for making a liquid toner for printing conductive traces. The method 400 includes dispersing 405 toner particles into a resin to form a mixture. The toner particles may include a low symmetry conductive pigment or a metal dispersed in a resin.

The method 400 further includes grinding 410 the mixture. The grinding may be done, for example, in a Deckel S1 grinder or other suitable ball mill or other grinder. The grinding mechanically mixes the pigment and resin so as to embed the pigment in the resin using mechanical force. Hence, a randomly dispersed pigment in the resin with partial coating of the pigment with resin is obtained. The grinding may be performed at an elevated temperature in the range of about 45° to 60° C. for a period of time in the range of about 30 to 45 hours.

The method 400 concludes with adding 415 the mixture to a carrier liquid to form the liquid toner. The carrier liquid may be any of the aliphatic hydrocarbons discussed above, including isoparaffins, such as ISOPAR®.

Figure 5:
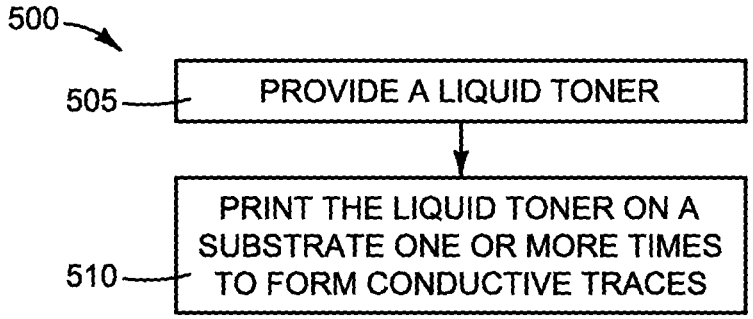
FIG. 5 is a flow chart, depicting a method for printing conductive traces, according to an example.

FIG. 5 is a flow chart depicting a method 500 for printing the liquid toner to form conductive traces. The method 500 includes providing 505 a liquid toner. The liquid toner may be any of the compositions described above containing low symmetry electrically conducting material.

The method concludes with printing 510 the liquid toner on a substrate one or more times to form the conductive traces.

EXAMPLES

A liquid toner was prepared, formulated from a resin, a low symmetry conductive material, a liquid carrier, and a dispersant.

The resin was a mix of two copolymers, F/ACE, in an 80:20 ratio, where F is Nucrel 699 (DuPont) and ACE is AC 5120 (Honeywell). The two copolymers were mixed in a Mayers production tool to give a resin paste.

The low symmetry conductive material was multi-wall carbon nanotubes (CNT), having a short length (0.5 to 2 micrometers), with an inside diameter of 3 to 5 nm and an outside diameter of 8 to 15. The CNT was acquired from NanoCyl and showed very low packing (very low tap density and low crystallinity, based on SEM photos), followed by very high dispersability in ISOPAR®-L. High dispersability was apparent in a high viscosity slurry when the CNT was dispersed in ISOPAR®-L in a low concentration (10 to 15 wt %).

The liquid carrier was ISOPAR®-L.

The dispersant was SOLSPERSE J560. Due to the very high viscosity of the CNT in ISOPAR®-L, the CNT was pre-dispersed in the isoparaffin liquid with the indicated dispersant for better dispersion and lower viscosity in grinding.

The solids composition was:

| | |
|---|---|
| CNT pigment | 30 wt %; |
| F/ACE resin | 58 wt %; |
| Al-di-stearate | 2 wt %; and |
| SOLSPERSE ® J560 | 10 wt %. |

The formulation was ground in a Deckel S1 grinder at 45° C. for 12 hours. An SEM photo after grinding revealed that the CNT fibers were encapsulated with F/ACE resin.

In preparing the ink, 8 wt % solids was combined with ISOPAR®. The charge director was an NCD mixture and was added at this time, in an amount of 2 wt %, based on the final ink composition.

Various compositions were prepared by varying the CNT pigment concentration. The resistance was measured for these compositions on films that were electroplated from a solution of 0.5 DMA (0.5 mg/cm$^2$). DMA is "defined mass per area" and gives an indication for the dried film thickness by the amount of material and density. At lower pigment loading (PL), the resistance was considerably higher than at higher PL, ranging from about 50,000Ω at a PL of 10 wt % to about 100Ω at a PL of 45 wt %. Thus, an optimized formulation having a highly conductive printed trace may have a PL of the carbon nanotubes of about 45%.

Heat curing the films reduced the resistance at the lower PL concentrations, but not at the higher PL concentrations. In the resistance dependency on PL, it was determined that at 45 wt % PL there was no difference of the resistance whether the sample was heat cured or not. This means that such films are saturated and when printed, there will be no need for curing.

Figure 6A:
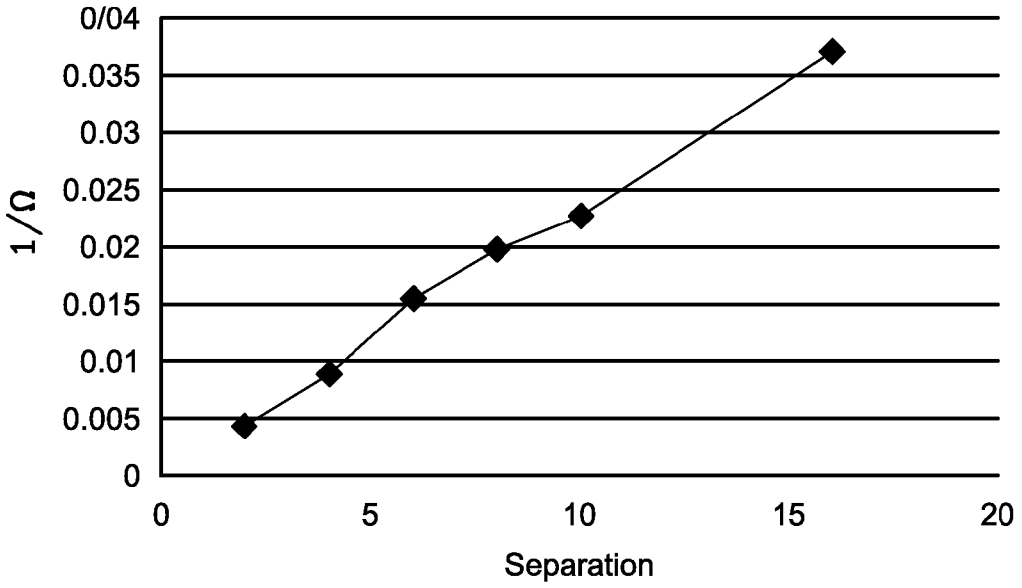
FIGS. 6A-6B respectively depict the conductivity (in reciprocal ohms) as a function of the number of layers and the resistance (in k-ohms) as a function of the number of layers, according to an example.
Figure 6B:
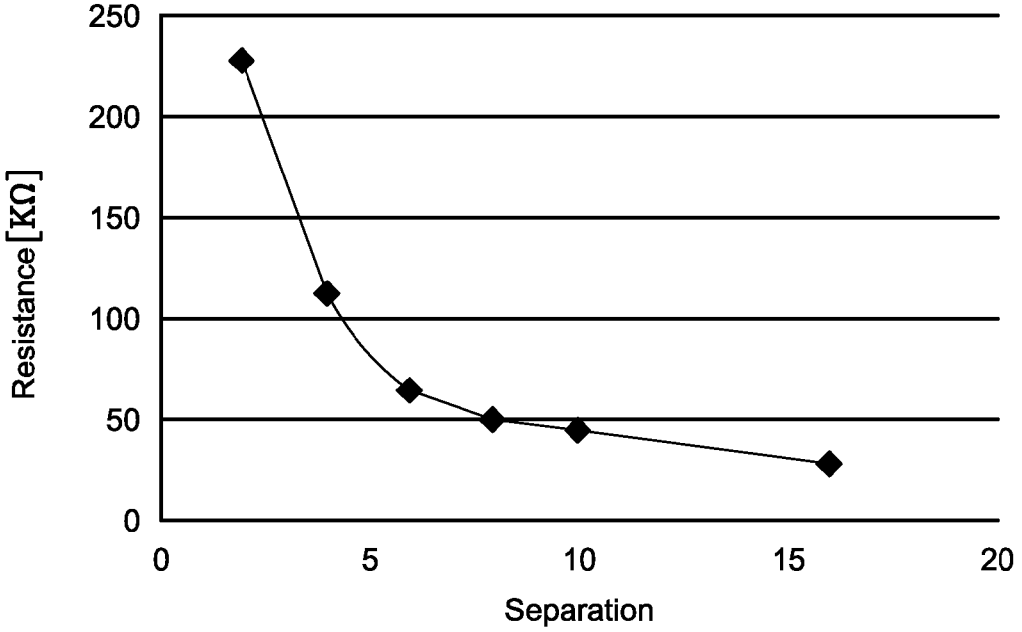

FIGS. 6A-6B illustrate the printing of CNT-based liquid toners having a PL of 30 wt %. FIG. 6A is a plot of the inverse of resistance (1/Ω) as a function of the number of printed layers, while FIG. 6A is a plot of resistance as a function of the number of printed layers. In both graphs, the conductivity is seen to increase with thickness (number of layers).

A ground formulation with 35% CNT PL, printed with 16 separations (layers), gave 5000Ω/□ with no curing and 300Ω/□ with mild curing (a few seconds at 300° C.).

Figure 7:
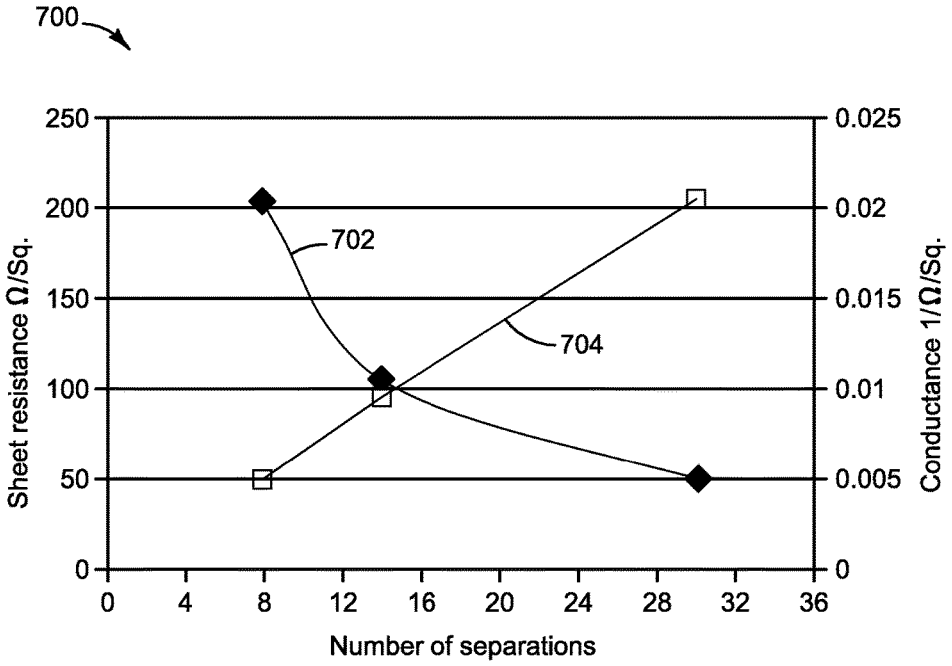
FIG. 7 depicts both the sheet resistance (in Ω/□) and conductance (in 1/Ω/□) as a function of the number of separations after heating.

FIG. 7 depicts both the resistance and conductance as a function of the number of separations after heating. The resistance is seen to decrease (and the conductance is seen to increase) with the number of separations.

As disclosed herein, a liquid toner has been provided that can be printed to give conductive traces. In some examples, the liquid toner is based on using carbon nanotubes as the pigment. The use of CNT pigment enables printing conductive ink using LEP.

What is claimed is:

1. A liquid toner for printing conductive traces, including:

a carrier liquid; and toner particles dispersed in the carrier liquid, the toner particles including an electrically conducting material and a dispersant embedded in a resin, the electrically conducting material having a shape of a flake, a fiber, or a tube.

2. The liquid toner of claim 1, wherein the electrically conducting material comprises a carbon-based material or a metal.

3. The liquid toner of claim 2, wherein the electrically conducting material is selected from the group consisting of carbon nanotubes, graphene, and the metal in the form of metallic flakes or nano-fibers.

4. The liquid toner of claim 3, wherein the electrically conducting material is the metal, and the metal is selected from the group consisting of aluminum, tin, a transition metal selected from the group consisting of zinc, copper, silver, gold, nickel, palladium, platinum, chromium, and iron, and an alloy selected from the group consisting of brass, bronze, and steel.

5. The liquid toner of claim 2, wherein the resin is selected from the group consisting of ethylene acid copolymers and ethylene vinyl acetate copolymers.

6. The liquid toner of claim 5, wherein the resin is selected from the group consisting of ethylene acrylic acid copolymers; ethylene methacrylic acid copolymers; ethylene vinyl acetate copolymers; copolymers of ethylene and $C_1$ to $C_5$ alkyl esters of methacrylic or acrylic acid; copolymers of ethylene, acrylic or methacrylic acid, and $C_1$ to $C_5$ alkyl esters of methacrylic or acrylic acid; polyethylene; polystyrene; isotactic polypropylene; ethylene ethyl acrylate; polyesters; polyvinyl toluene; polyamides; styrene/butadiene copolymers; epoxy resins; acrylic resins, including copolymers of acrylic or methacrylic acid and at least one $C_1$ to $C_{20}$ alkyl esters of acrylic or methacrylic acid; ethylene-acrylate terpolymers: ethylene-acrylic esters-maleic anhydride or glycidyl methacrylate (GMA) terpolymers; ethylene-acrylic acid ionomers, and combinations thereof.

7. The liquid toner of claim 1, wherein the carrier liquid is a non-polar liquid selected from the group consisting of paraffinic liquids, mineral spirits, petroleum distillates, and aromatic solvents.

8. The liquid toner of claim 1, further including an other dispersant, a charge director, or both.

9. The liquid toner of claim 8, wherein the other dispersant is selected from the group consisting of anionic surfactants, cationic surfactants, amphoteric surfactants, non-ionic surfactants, polymeric surfactants, oligomeric surfactants, crosslinking surfactants, and combinations thereof and wherein the charge director is a sulfosuccinate salt of a general formula MAn, wherein M is a metal, n is a valence of M, and A is an ion of the general formula (IV):

$$[R^1—O—C(O)CH_2CH(SO_3)C(O)—O—R^2]^- \qquad \text{Formula (IV)}$$

wherein each of $R^1$ and $R^2$ is an alkyl group.

10. The liquid toner of claim 1, wherein the dispersant is a surfactant of formula (I):

Formula (I)

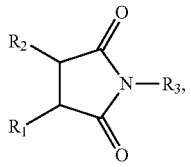

wherein each of $R_1$, $R_2$ and $R_3$ is an amine-containing head group, a hydrocarbon tail group, or hydrogen;

wherein at least one of $R_1$, $R_2$ and $R_3$ has the hydrocarbon tail group; and wherein at least one of $R_1$, $R_2$ and $R_3$ has the amine-containing head group.

11. The liquid toner of claim 10, wherein the hydrocarbon tail group is of formula (II):

$$\text{P-L-} \qquad \text{Formula (II)}$$

wherein P is polyisobutylene and L is O, NH, or $(CH_2)_n$, wherein n is from 1 to 5.

12. The liquid toner of claim 10, wherein the amine-containing head group is of formula (III):

$$(CH_2)_m[(CH_2)_oNH(CH_2)_p]_q(CH_2)_r—NH_2 \qquad \text{Formula (III)}$$

wherein m is from 1 to 5, o is 0, 1 or 2, p is 1 or 2, q is from 0 to 10, and r is from 0 to 10.

13. The liquid toner of claim 1, wherein the dispersant is a polyisobutylene succinamide.

14. The liquid toner of claim 1, wherein the electrically conducting material forms a conducting line in the resin.

15. A method of making a liquid toner for printing conductive traces, the method comprising:

coating a dispersant on an electrically conducting material, the electrically conducting material having a shape of a flake, a fiber, or a tube;

dispersing the dispersant coated electrically conducting material into a resin to form a mixture;

grinding the mixture to embed the dispersant coated electrically conducting material in the resin using mechanical force; and adding the mixture to a carrier liquid to form the liquid toner.

16. The method of claim 15, wherein the electrically conducting material is selected from the group consisting of carbon nanotubes, graphene, and a metal in the form of metallic flakes or nano-fibers, wherein the metal is selected from the group consisting of aluminum, tin, a transition metal selected from the group consisting of zinc, copper, silver, gold, nickel, palladium, platinum, chromium, and iron, and an alloy selected from the group consisting of brass, bronze, and steel.

17. The method of claim 16, wherein the carbon nanotubes have a pigment loading of 30% or more in the liquid toner.

18. A method for printing conductive traces, the method comprising:

providing a liquid toner, the liquid toner including:

a carrier liquid, and toner particles dispersed in the carrier liquid, the toner particles comprising an electrically conducting material and a dispersant embedded in a resin, the electrically conducting material having a shape of a flake, a fiber, or a tube; and printing the liquid toner on a substrate one or more times to form the conductive traces.

19. The method of claim 18, wherein the electrically conducting material is selected from the group consisting of carbon nanotubes, graphene, and a metal in the form of metallic flakes or nano-fibers, wherein the metal is selected from the group consisting of aluminum, tin, a transition metal selected from the group consisting of zinc, copper, silver, gold, nickel, palladium, platinum, chromium, and iron, and an alloy selected from the group consisting of brass, bronze, and steel, and wherein the carrier liquid is a non-polar liquid selected from the group consisting of paraffinic liquids, mineral spirits, petroleum distillates, and aromatic solvents.

* * * * *